US006030503A

United States Patent [19]

Matuschczyk

[11] Patent Number: 6,030,503

[45] Date of Patent: Feb. 29, 2000

[54] PRESS SLEEVE FOR A PRESS DEVICE

[75] Inventor: Uwe Matuschczyk, Geislingen, Germany

[73] Assignee: Voith Sulzer Papiermaschinen GmbH, Heidenheim, Germany

[21] Appl. No.: 08/917,291

[22] Filed: Aug. 25, 1997

[30] Foreign Application Priority Data

Sep. 13, 1996 [DE] Germany ..... 196 37 477

[51] Int. Cl.[7] ..... D21F 3/08

[52] U.S. Cl. ..... 162/358.4; 162/901; 492/30

[58] Field of Search ..... 162/358.3, 358.4, 162/901; 492/30, 48

[56] References Cited

U.S. PATENT DOCUMENTS

| | | | |
|---|---|---|---|
| Re. 31,923 | 6/1985 | Justus et al. | 162/358.3 |
| 1,925,917 | 9/1933 | Chalon | 162/901 |
| 4,366,025 | 12/1982 | Gordon, Jr. | 162/358.1 |
| 4,482,430 | 11/1984 | Majaniemi | 162/358.4 |
| 4,559,258 | 12/1985 | Kiuchi | 162/358.4 |
| 4,944,820 | 7/1990 | McCarten | 162/901 |
| 5,342,277 | 8/1994 | Steiner et al. | 492/56 |

FOREIGN PATENT DOCUMENTS

| | | |
|---|---|---|
| 4237091 | 5/1993 | Germany . |
| 4401580 | 6/1994 | Germany . |
| 4411621 | 10/1995 | Germany . |
| 4445472 | 6/1996 | Germany . |

OTHER PUBLICATIONS

Kohler, "Erfahrungen mit Polyurethan–Walzenbezügen bei der Herstellung Merlagiger bahnen," *Wochenblatt für Papierfabrikation,* vol. 20, pp. 905–908 (1987).

*Primary Examiner*—Karen M. Hastings
*Attorney, Agent, or Firm*—Greenblum & Bernstein, P.L.C.

[57] ABSTRACT

Press sleeve for de-watering a material sheet in a press nip having a width. The press sleeve may extend transverse to a travel direction of the material sheet and may include a flexible material, a pressing area, adapted to form the press nip, having two ends, end sections positioned adjacent to each end of the pressing areas, and recesses located on an exterior surface to take up water. The press sleeve may also include outer sections including portions of the pressing area and portions of the end section, an inner section including a portion located between the outer sections. The recesses located within the outer sections may include a plurality of recesses having a limited length in the travel direction and the recesses located within the inner section may include grooves substantially extending endlessly in the travel direction.

20 Claims, 1 Drawing Sheet

PRESS SLEEVE FOR A PRESS DEVICE

CROSS-REFERENCE TO RELATED APPLICATION

The present application claims priority under 35 U.S.C. § 119 of German Patent Application No. 196 37 477.4 filed Sep. 13, 1996, the disclosure of which is expressly incorporated by reference herein in its entirety.

BACKGROUND OF THE INVENTION

1. Field of the Invention

The present invention relates to a press sleeve or jacket made of a flexible material for use in a press device for draining or de-watering a material sheet in a press nip or gap. The press sleeve may extend transverse to a direction of travel of the material sheet, and over a pressing area that is substantially equivalent to a width of the press nip and over end sections that are adjacent to both sides of the press nip. Grooves are provided on an exterior side of the press sleeve to take up water.

2. Discussion of Background Information

A press sleeve of the type generally described above is discussed, e.g., in German Patent Application No. DE 44 01 580 A1. The press sleeve is provided with grooves that extend along the entire width of the sleeve for de-watering in a run direction of the sheet. In addition, more grooves or holes can be provided to increase the elasticity of the press sleeve. However, these additional grooves or holes are not utilized for the purpose of de-watering.

The water grooves, which are provided along the entire width of the press sleeve, have the disadvantage that, over time, damages occur, in particular in the form of cracks. These damages are due to weakening the press sleeve in the area of the grooves.

SUMMARY OF THE INVENTION

The present invention provides a press sleeve of the type generally discussed above in which the risk for damages, in particular crack formations, in the press sleeve may be reduced without adversely effecting the de-watering or draining capacity of the press sleeve.

The present invention provides a press sleeve having recesses located on both ends of the press sleeve forming an outer section. The outer section may extend from within a pressing area to an end of the press sleeve. The recesses may include a plurality of recesses having a limited length in a travel direction of the sheet, and the remaining portion (or inner section) of the roll sleeve may include grooves that extend substantially continuously in the travel direction.

The grooves located in the inner section of the press sleeve ensure a sufficient de-watering or draining capacity is ensured, comparable to the capacity of the prior art press sleeves, while the recesses of limited length prevent formation of cracks in the outer sections. The arrangement of the present invention is advantageous because it has been determined that damages mainly occur within the transitional areas, e.g., between the press section and the adjacent end sections. While damages may occur in the recesses of limited length located within the two outer sections due to the high stresses exerted upon them, the spreading out of these damages is restricted due to the limited length of the recesses.

By combining grooves within the inner section that extend in the travel direction with recesses of limited length in the two outer areas, a high degree of durability of the roll sleeve may be achieved without adversely effecting the press sleeve's overall effectiveness in de-watering or taking up water.

The recesses in the two outer sections of the press sleeve may be preferably designed as blind holes that may exhibit a shape of, e.g., a circle, a polygon, or an oval. The grooves located within the inner section may be formed to run, e.g., either straight in the travel direction of the sheet run or in a shape of a sinuous wave or zig-zag pattern.

The total opening area of the recesses for each surface unit of the roller sleeve may be preferably substantially the same in the inner section as in both outer sections. The total capacity of the recesses for each surface unit of the roller sleeve may be preferably the same in the inner section as in both outer sections of the roller sleeve. However, deviations may be present in both cases in a range of, e.g., approximately ±10%. Thus, an even draining or de-watering of the material sheet over its entire width may be ensured.

The present invention may be preferably utilized as a press sleeve for a shoe press, and may alternatively be utilized in a press sleeve of a rigid roller.

The present invention is directed to a press sleeve for de-watering a material sheet in a press nip having a width. The press sleeve may extend transverse to a travel direction of the material sheet and may include a flexible material, a pressing area, adapted to form the press nip, having two ends, end sections positioned adjacent to each end of the pressing areas, and recesses located on an exterior surface to take up water. The press sleeve may also include outer sections including portions of the pressing area and portions of the end section, an inner section including a portion located between the outer sections. The recesses located within the outer sections may include a plurality of recesses having a limited length in the travel direction and the recesses located within the inner section may include grooves substantially extending endlessly in the travel direction.

In accordance with another feature of the present invention, the recesses located within the outer sections may include blind holes. Further, the blind holes may include at least one of a circular cross-section, a polygonal cross-section, and an oval-shaped cross-section.

In accordance with still another feature of the present invention, the grooves may include a substantially straight line run in the travel direction. Alternatively, the grooves may include a substantially sinuous wave pattern run in the travel direction or a substantially zig-zag pattern run in the travel direction.

In accordance with a further feature of the present invention, a total opening area of the recesses located within the inner section may be substantially the same as the total opening area of the recesses located within both outer sections.

In accordance with a still further feature of the present invention, a total capacity of the recesses located within the inner section may be substantially the same as the total capacity of the recesses located within both outer sections.

The present invention may be directed to a press sleeve for de-watering a material sheet. The press sleeve may include a pressing area, adapted to form a press nip, having two ends, end sections positioned adjacent to each end of the pressing areas, at least one outer section including a portion of the pressing area and a portion of the end section, and an inner section including a portion located adjacent the at least one outer section. A plurality of holes may be formed within the at least one outer section and a plurality of grooves may be formed within the inner section extending substantially circumferentially around the press sleeve.

In accordance with another feature of the present invention, the plurality of holes may include blind holes. Further, the blind holes may include at least one of a polygonal and a rounded shape.

In accordance with another feature of the present invention, the plurality of grooves may include endless grooves. Further, the endless grooves may include one of a straight line, a zig-zag line, and a sinuous wave line.

In accordance with still another feature of the present invention, the at least one outer section may include two outer sections, and each outer section may be located adjacent an end of the inner section. Further, the two outer sections may have a first total opening area including the plurality of holes, and the inner section having a second total opening area including the plurality of grooves. The first and second total opening areas may be substantially equal. Still further, the first and second total opening areas may include a ratio of opening area to a total surface area of the two outer surfaces and the inner surface, respectively. For example, the ratio may be approximately 30%.

In accordance with yet another feature of the present invention, the two outer sections may have a first total opening capacity including the plurality of holes, and the inner section may have a second total opening capacity including the plurality of grooves. The first and second total opening capacities may be substantially equal. For example, the first and second total opening capacities may be approximately 300 $cm^3/m^2$.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
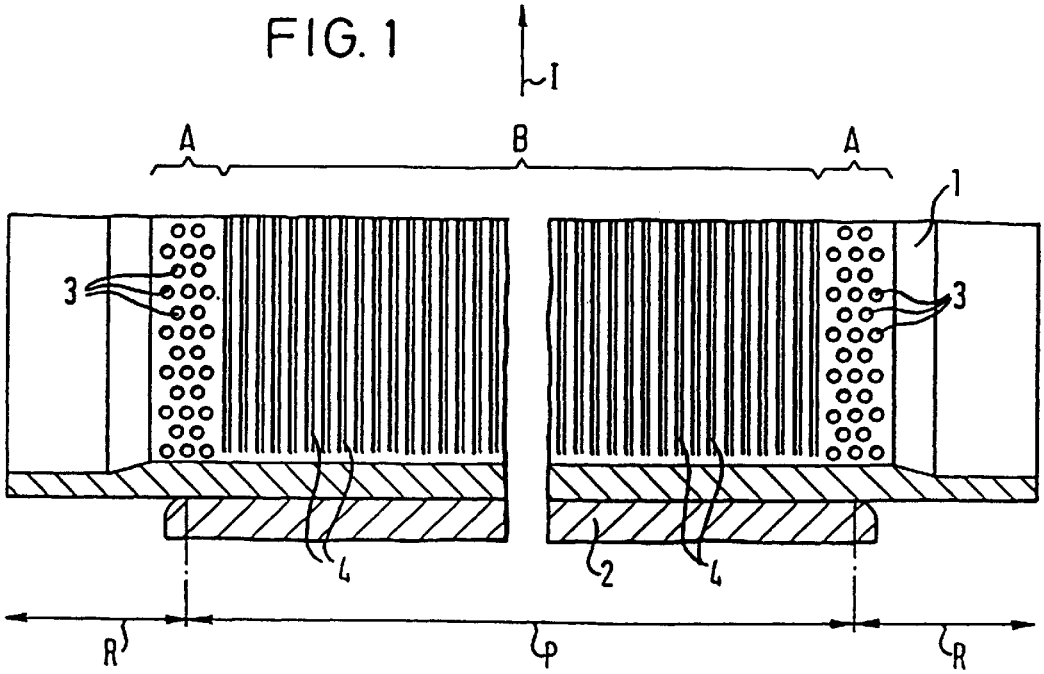
FIG. 1 illustrates a top view of a press sleeve for use with a press shoe in accordance with the present invention.

A press sleeve 1, shown in FIG. 1, extends perpendicular to direction of travel I of a material sheet. Press sleeve 1 may contact a press shoe 2 to form a press nip or gap. As shown, press sleeve 1 may extend over a pressing area P defined by a width of press shoe 2 and may further extend over two lateral end sections R located on opposite ends, and adjacent to, pressing area P. Press sleeve 1 may be provided with a tapering thickness toward its ends, in a known manner.

The surface of press sleeve 1 may be provided with recesses 3 and 4 utilized for the uptake of water and the de-watering of the material sheet, in particular a paper sheet, that may be guided through the press nip. Press sleeve 1 may be composed of an elastomeric material, preferably polyurethane, having a hardness of, e.g., approximately 85–95 Shore A.

Figure 2:
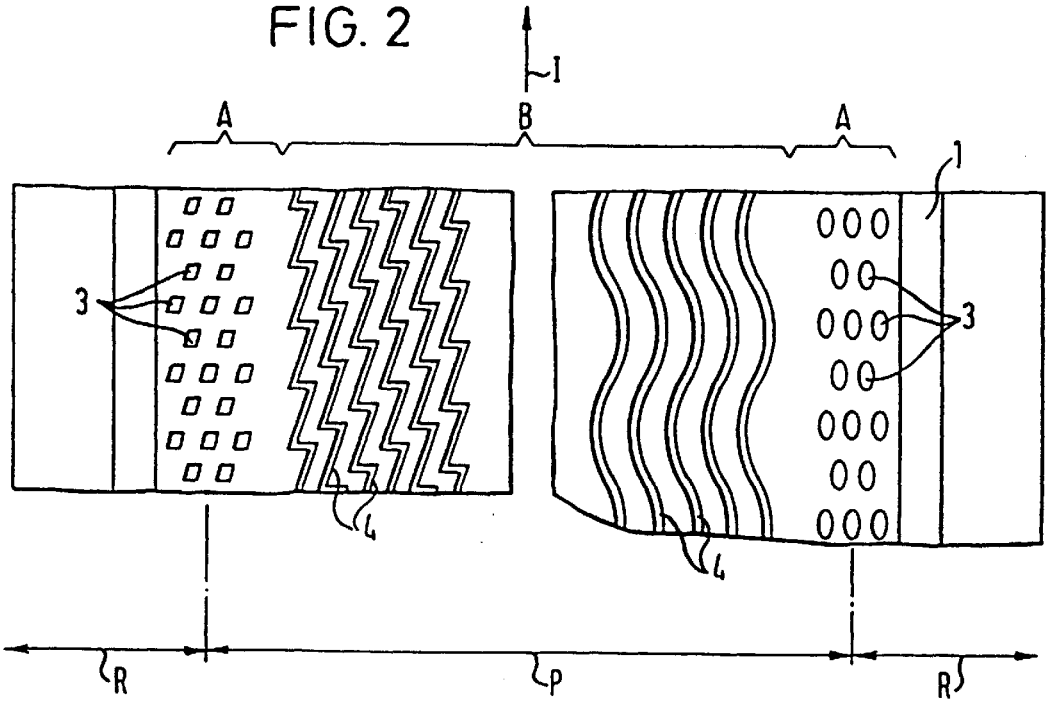
FIG. 2 illustrates a top view of alternative arrangements for the press sleeve in accordance with the present invention.

Press sleeve 1 may include two outer sections A, which may be positioned to start within the region of press roll 1 associated with pressing area P and extend into the region of press roll 1 associated with end section R. The recesses 3 provided within outer sections A of press sleeve 1 may be, e.g., blind holes 3 which may exhibit a certain cross-sectional shape, such as, e.g., a circle, as depicted in FIG. 1. As shown in FIGS. 1 and 2, outer sections A do not have grooves formed therein. The circle may have a diameter of, e.g., approximately 2.0–2.5 mm. Press sleeve 1 may also include an inner section B located between and adjacent the two outer sections A. The recesses 4 provided within inner section B of press sleeve 1 may be, e.g., straight grooves 4 extending in the travel direction. The width of the grooves may be, e.g., approximately 0.7–1.2 mm. As shown in FIGS. 1 and 2, inner section B does not have blind holes formed therein.

A specific number and specific cross-section of holes 3 and grooves 4 may be selected such that a total opening area of recesses 3 in outer sections A of press sleeve 1 may be substantially equal to the total opening area of recesses 4 in inner section B of press sleeve 1. In this manner, roller sleeve 1 may provide sufficient draining or de-watering capacity over the entire pressing area P. In a preferred embodiment of the present invention, inner section B may include, e.g., approximately 65 recesses 3 (or holes) per 1000 $mm^2$ and outer section A may include, e.g., approximately 35 recesses 4 (or grooves) per 100 mm. If a different draining or de-watering capacity is desired over pressing area P, the specific number and the total area of the cross-sectional area of the openings of recesses 3 and 4 may, of course, be varied appropriately. The same is true for the overall capacity of recesses 3 and 4, i.e., a total capacity of the recesses 3 located within the outer sections A may be substantially equal to the total capacity of the recesses 4 located within the inner section B. For example, a depth of the recesses 3 may be, e.g., approximately 1.5–2.5 mm and a depth of recesses 4 may be, e.g., approximately 0.5–1.5 mm.

An alternative embodiment of press sleeve 1 is illustrated in FIG. 2. In FIG. 2, alternative cross-sectional shapes for recesses 3 and 4 are depicted for use in press sleeve 1. In the left half of FIG. 2, recesses 3 are depicted as having a cross-sectional shape of a parallelogram within outer section A and recesses 4 are depicted as a plurality of zig-zag shaped grooves within inner section B and extending in the travel direction. An area of the opening formed by parallelogram recesses 3 may be, e.g., substantially similar to that discussed above with the circular holes.

In the right half of FIG. 2, recesses 3 are depicted as having a cross-sectional rounded shape of an oval within outer section A and recesses 4 are depicted as a plurality of sinuous wave shaped grooves positioned within inner section B. The different shapes of recesses 3 and 4 may be combined as desired, i.e. not all of the variations shown in FIG. 2 must be included in a single press sleeve 1. Further, other variations of the shapes of recesses 3 and 4 may be possible as long as recesses 4 in inner section B extend continuously in the travel direction, and the recesses 3 in both outer sections A are of limited length in the travel direction.

As discussed above, it is preferred that the total opening area of outer sections A is substantially equal to the total opening area of inner section B. Thus, a total area of the openings formed by the recesses 3, i.e., in outer sections A, may be, e.g., approximately 30% of an overall surface area of outer sections A, and a total area of the openings formed by grooves 4, i.e., in inner section B, may be, e.g., approximately 30% of the overall surface areas of inner section B. Further, a capacity of recesses 3, in outer sections B, and a capacity of grooves 4, in inner section A, may be, e.g., approximately 300 $cm^3/m^2$.

Recesses 3 of limited length in the two outer sections A prevent the spreading of cracks which may form during the operation of the press device, e.g., due to the stresses exerted upon press sleeve 1. Further, a good draining or de-watering capacity of press sleeve 1 may be ensured by grooves 4 extending continuously in the travel direction and located within inner section B.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

Reference List

1 Press Sleeve
2 Press Shoe
3 Recess - Hole
4 Recess - Groove
I Travel Direction of the Material Sheet
A Outer Section
B Inner Section
P Pressing Area
R End Section

What is claimed:

1. A press sleeve for de-watering a material sheet in a press nip having a width, the press sleeve extending transverse to a travel direction of the material sheet and comprising:

a flexible material;

a pressing area, adapted to form the press nip, having two ends;

end sections positioned adjacent to each end of the pressing areas;

blind recesses located on an exterior surface to take up water;

outer sections comprising portions of the pressing area and portions of the end section;

an inner section comprising a portion located between the outer sections;

the recesses located within the outer sections consisting of a plurality of blind holes having a limited length in the travel direction;

the recesses located within the inner section consisting of grooves extending endlessly in the travel direction.

2. The press sleeve in accordance with claim 1, the blind holes comprising a circular cross-section.

3. The press sleeve in accordance with claim 1, the blind holes comprising a polygonal cross-section.

4. The press sleeve in accordance with claim 1, the blind holes comprising an oval-shaped cross-section.

5. The press sleeve in accordance with claim 1, the grooves comprising a substantially straight line run in the travel direction.

6. The press sleeve in accordance with claim 1, the grooves comprising a substantially sinuous wave pattern run in the travel direction.

7. The press sleeve in accordance with claim 1, the grooves comprising a substantially zig-zag pattern run in the travel direction.

8. The press sleeve in accordance with claim 1, a total opening area of the recesses located within the inner section is substantially the same as the total opening area of the recesses located within both outer sections.

9. The press sleeve in accordance with claim 1, a total capacity of the recesses located within the inner section is substantially the same as the total capacity of the recesses located within both outer sections.

10. A press sleeve for de-watering a material sheet comprising:

a pressing area, adapted to form a press nip, having two ends;

end sections positioned adjacent to each end of the pressing areas;

at least one outer section comprising a portion of the pressing area and a portion of the end section;

an inner section comprising a portion located adjacent the at least one outer section;

only a plurality of blind holes being formed within the at least one outer section; and only a plurality of grooves being formed within the inner section extending entirely around the press sleeve.

11. The press sleeve according to claim 10, the blind holes comprising at least one of a polygonal and a rounded shape.

12. The press sleeve according to claim 10, the plurality of grooves comprising endless grooves.

13. The press sleeve according to claim 12, the endless grooves comprising one of a straight line, a zig-zag line, and a sinuous wave line.

14. The press sleeve according to claim 10, the at least one outer section comprising two outer sections, each outer section being located adjacent an end of the inner section.

15. The press sleeve according to claim 14, the two outer sections having a first total opening area comprising the plurality of holes, and the inner section having a second total opening area comprising the plurality of grooves; and the first and second total opening areas being substantially equal.

16. The press sleeve according to claim 15, the first and second total opening areas comprising a ratio of opening area to a total surface area of the two outer surfaces and the inner surface, respectively.

17. The press sleeve according to claim 16, the ratio being approximately 30%.

18. The press sleeve according to claim 14, the two outer sections having a first total opening capacity comprising the plurality of holes, and the inner section having a second total opening capacity comprising the plurality of grooves; and the first and second total opening capacities being substantially equal.

19. The press sleeve according to claim 18, each of the first and second total opening capacities being approximately 300 $cm^3/m^2$.

20. A press sleeve for de-watering a material sheet comprising:

a pressing area, adapted to form a press nip, having two ends;

end sections positioned adjacent to each end of the pressing areas;

at least one outer section comprising a portion of the pressing area and a portion of the end section;

an inner section comprising a portion located adjacent the at least one outer section;

the at least one outer section being formed with blind holes and without grooves; and the inner section being formed with endless grooves and without blind holes.

* * * * *